US007341371B2

(12) United States Patent
Kuo et al.

(10) Patent No.: US 7,341,371 B2
(45) Date of Patent: Mar. 11, 2008

(54) LED LIGHT ASSEMBLY WITH LED CONNECTING DEVICE

(75) Inventors: Ming-Shan Kuo, Tainan (TW); Wei-Jen Chen, Tainan (TW)

(73) Assignee: TYC Brother Industrial Co., Ltd., Tainan (TW)

( * ) Notice: Subject to any disclaimer, the term of this patent is extended or adjusted under 35 U.S.C. 154(b) by 187 days.

(21) Appl. No.: 11/255,005

(22) Filed: Oct. 21, 2005

(65) Prior Publication Data

US 2007/0091604 A1 Apr. 26, 2007

(51) Int. Cl.
*H01R 33/09* (2006.01)

(52) U.S. Cl. ..... 362/659; 362/652; 362/545; 439/890; 439/669.2

(58) Field of Classification Search ..... 362/646, 362/657–659, 545, 652, 252; 439/36, 56, 439/395, 404, 443, 890, 414, 417–419, 336, 439/541, 619, 699.2, 918
See application file for complete search history.

(56) References Cited

U.S. PATENT DOCUMENTS 876,233 A * 1/1908 Plass ..... 439/414
1,287,542 A * 12/1918 Whitney ..... 439/414
4,471,414 A * 9/1984 Savage, Jr. ..... 362/652
4,727,648 A * 3/1988 Savage, Jr. ..... 439/56
5,078,625 A * 1/1992 Anzai ..... 439/699.2
5,389,010 A * 2/1995 Takano et al. ..... 439/56
5,672,000 A * 9/1997 Lin ..... 362/653
5,823,816 A * 10/1998 Uchida et al. ..... 439/36
6,345,902 B2 * 2/2002 Ohkohdo et al. ..... 362/249
6,840,776 B2 * 1/2005 Sørensen et al. ..... 439/56
7,217,012 B2 * 5/2007 Southard et al. ..... 362/252
2004/0141337 A1 * 7/2004 Kaga et al. ..... 362/545
2005/0207151 A1 * 9/2005 Aanegola et al. ..... 362/227

* cited by examiner

*Primary Examiner*—Ismael Negron
(74) *Attorney, Agent, or Firm*—Rosenberg, Klein & Lee

(57) ABSTRACT

An LED light assembly includes a backboard having a plurality of insertion ports on a rear end thereof and each insertion port receives an LED assembly. A plurality of holes are defined through the backboard so that the LEDs extend through the hole. Each LED assembly includes a base to be received in the insertion port and two conductive plates are connected to the base. The LED has legs extending through leg slots in a top of each base and being clamped by clamp slots defined in the conductive plates so as to form a circuit. Each conductive plate has a hook portion to be securely connected to the base and a cable slot so as to organize cables connected to the LEDs.

6 Claims, 7 Drawing Sheets

LED LIGHT ASSEMBLY WITH LED CONNECTING DEVICE

FIELD OF THE INVENTION

The present invention relates to an LED light assembly, and more particularly, to an LED positioning device for easily positioning LEDs to a backboard of an LED light assembly.

BACKGROUND OF THE INVENTION

A conventional LED light assembly for vehicles generally includes a cover and a backboard on which the LEDs are fixed. The cover includes a plurality of holes through which the LEDs extend. The cover further includes a plurality of convexes and concaves so as to have desired results of refraction. The backboard is used to fix the LEDs which are welded to the backboard and the backboard is then connected to the cover and insert the LEDs through the holes in the cover. However, the cover is not smooth and may have specific shape so that the backboard is difficult to matched with the cover. Therefore, the LEDs cannot evenly inserted into the holes and some LEDs are located close to the outer surface of the cover and some are located to have a distance from the outer surface of the cover. This affects the result of refraction. Some manufacturers are forced to cut the backboard into several parts and connect the parts one by one so as to comply with the specific shape of the cover. Besides, the welding processes take a lot of time and the legs of the LEDs might be broken during welding.

The present invention intends to provide an LED light assembly wherein the LEDs can be easily installed to the backboard.

SUMMARY OF THE INVENTION

The present invention relates to an LED light assembly which comprises a backboard having a plurality of insertion ports on a rear end thereof and a plurality of holes are defined through the backboard and communicate with the insertion ports. A plurality of LED assemblies are inserted into the insertion ports and each LED assembly includes a base and two conductive plates. Each conductive plate has a bent portion inserted into a side hole in the base and having a plurality of clamping slots. An LED includes a plurality of legs inserted through leg slots in a top of each base and the legs are clamped by the clamping slots of the bent portions of the conductive plates. The LEDs extend through the holes of the backboard.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
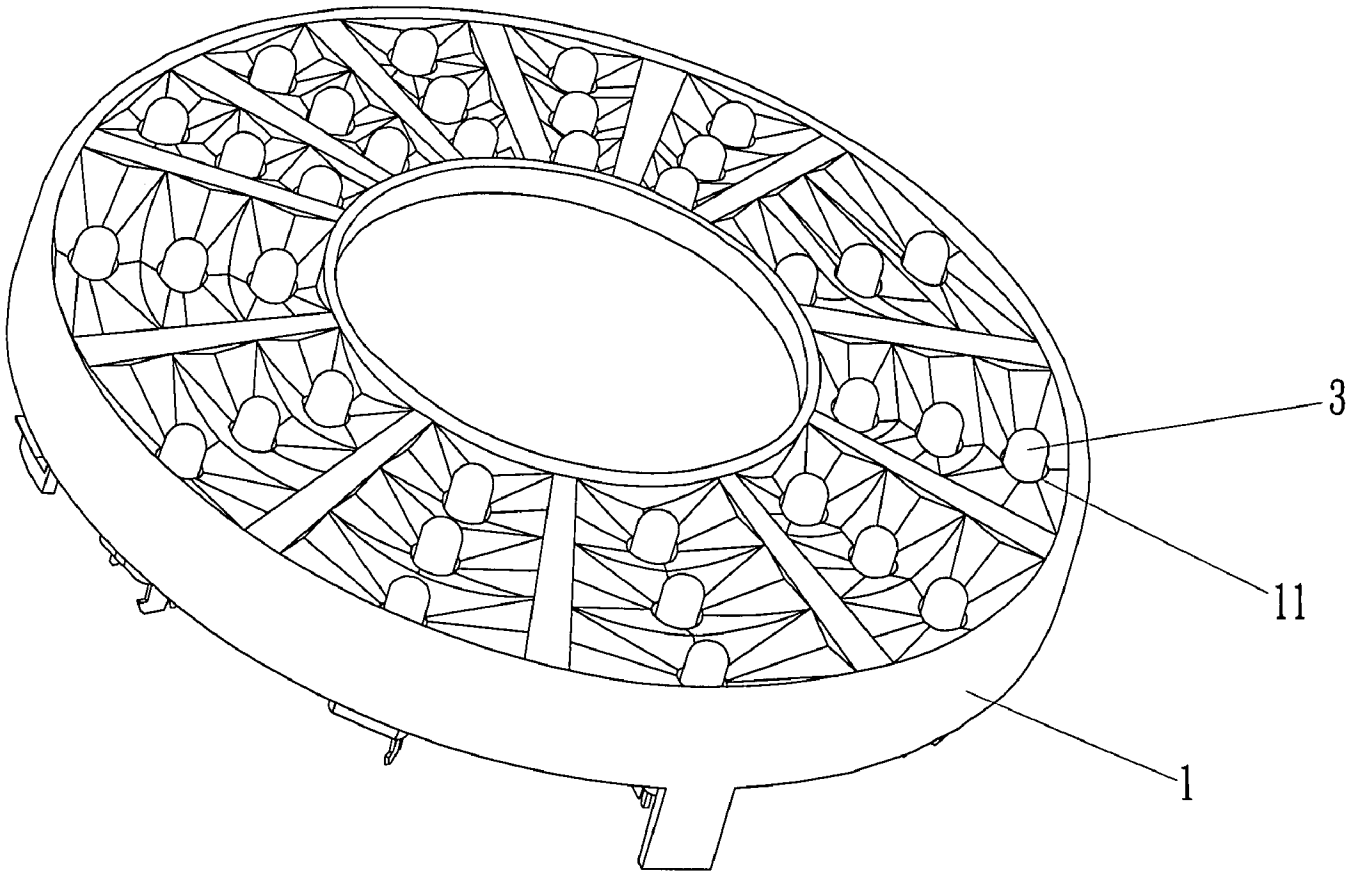
FIG. 1 is a perspective view of the LED light assembly of the present invention.
Figure 2:
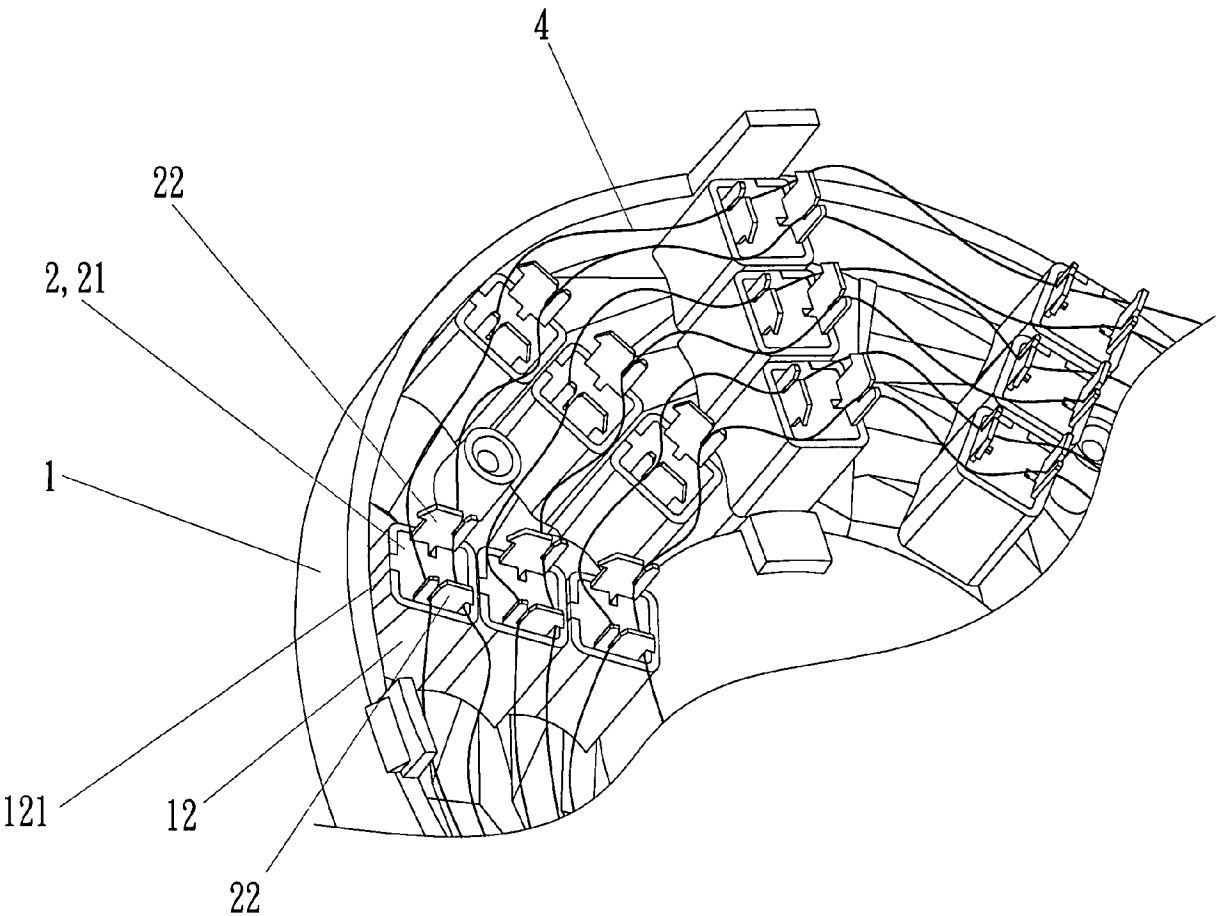
FIG. 2 is a partial view of the rear end of the LED light assembly of the present invention.
Figure 3:
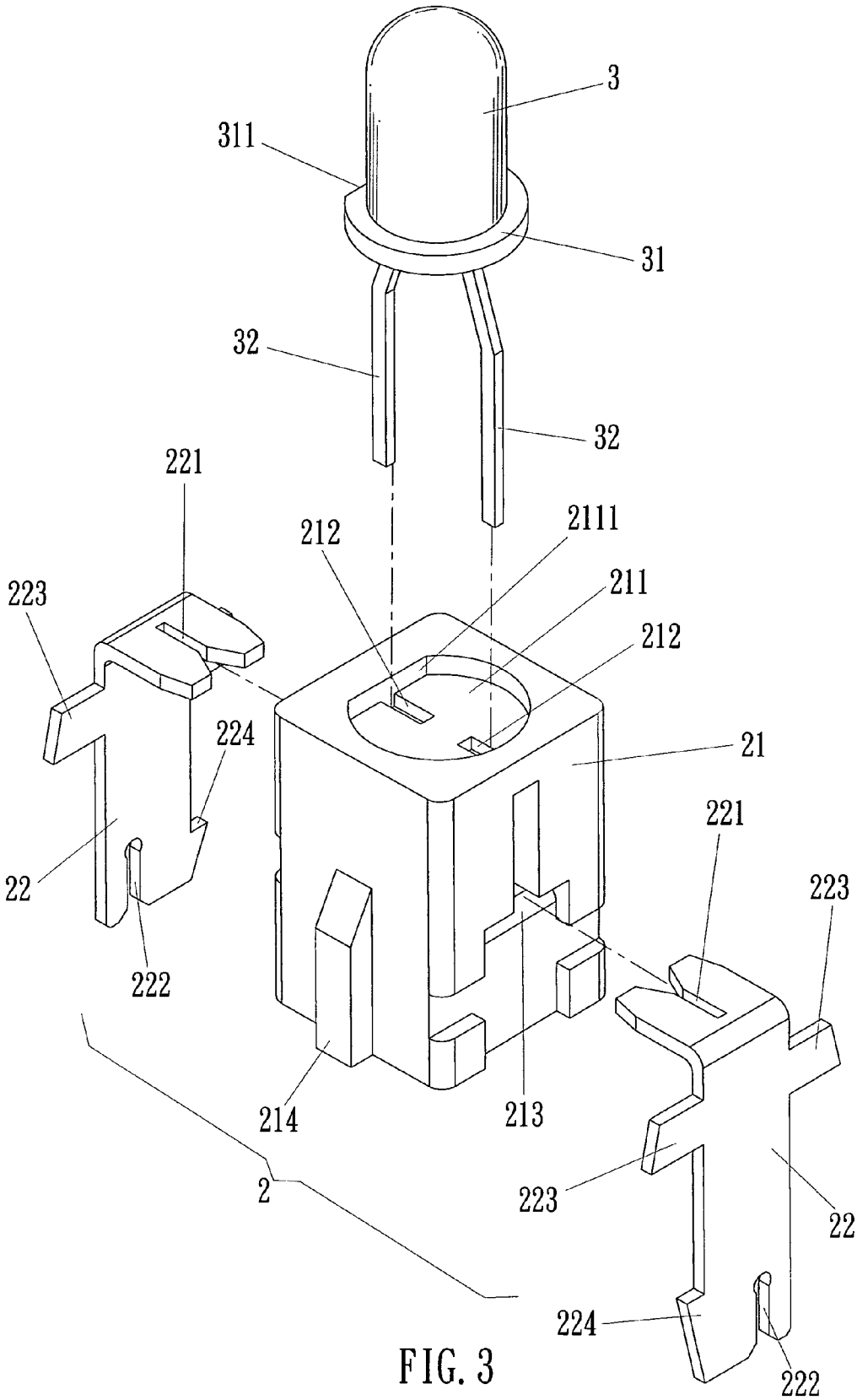
FIG. 3 is an exploded view to show the LED assembly of the present invention.
Figure 4:
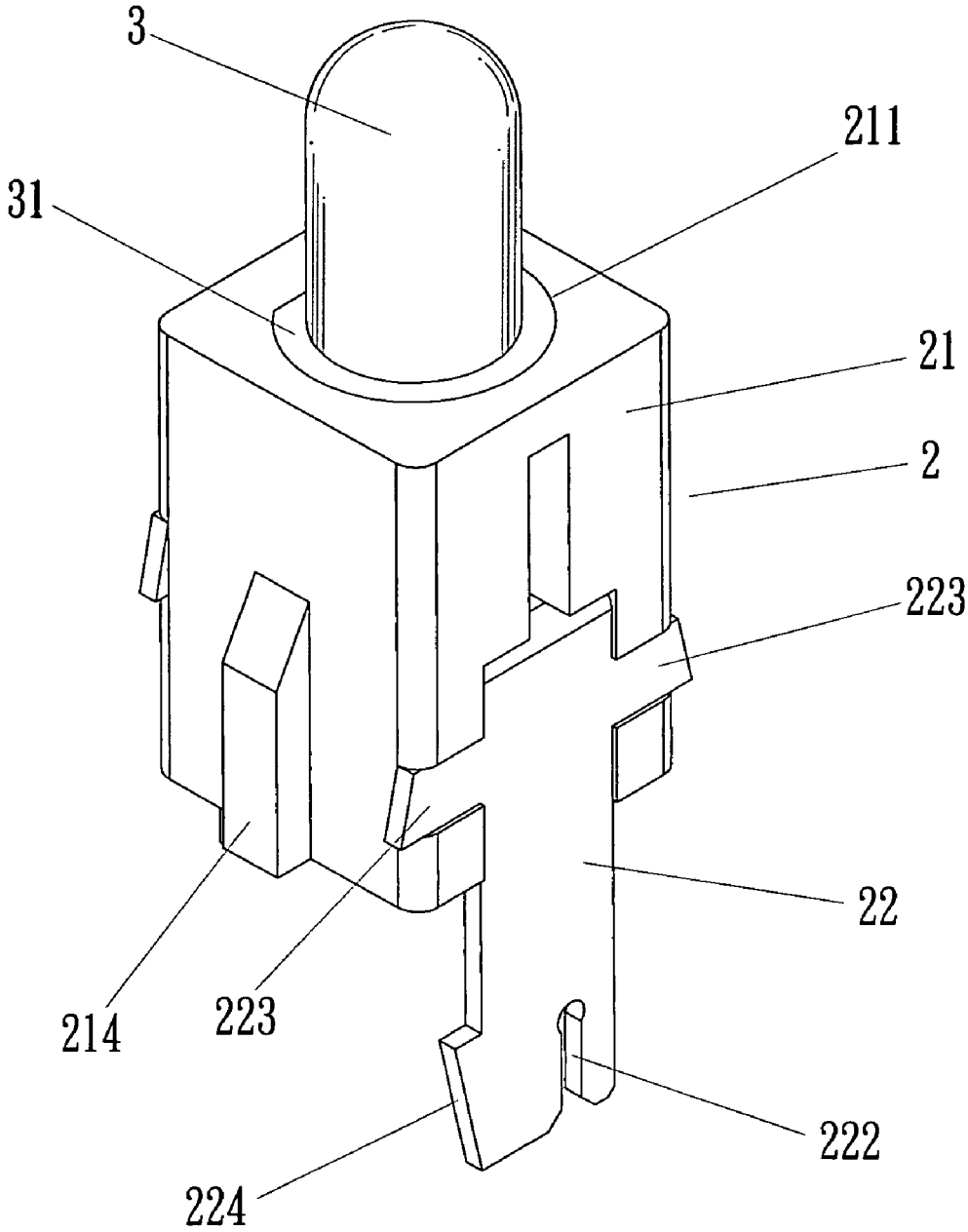
FIG. 4 is a perspective view of the LED assembly of the present invention.
Figure 5:
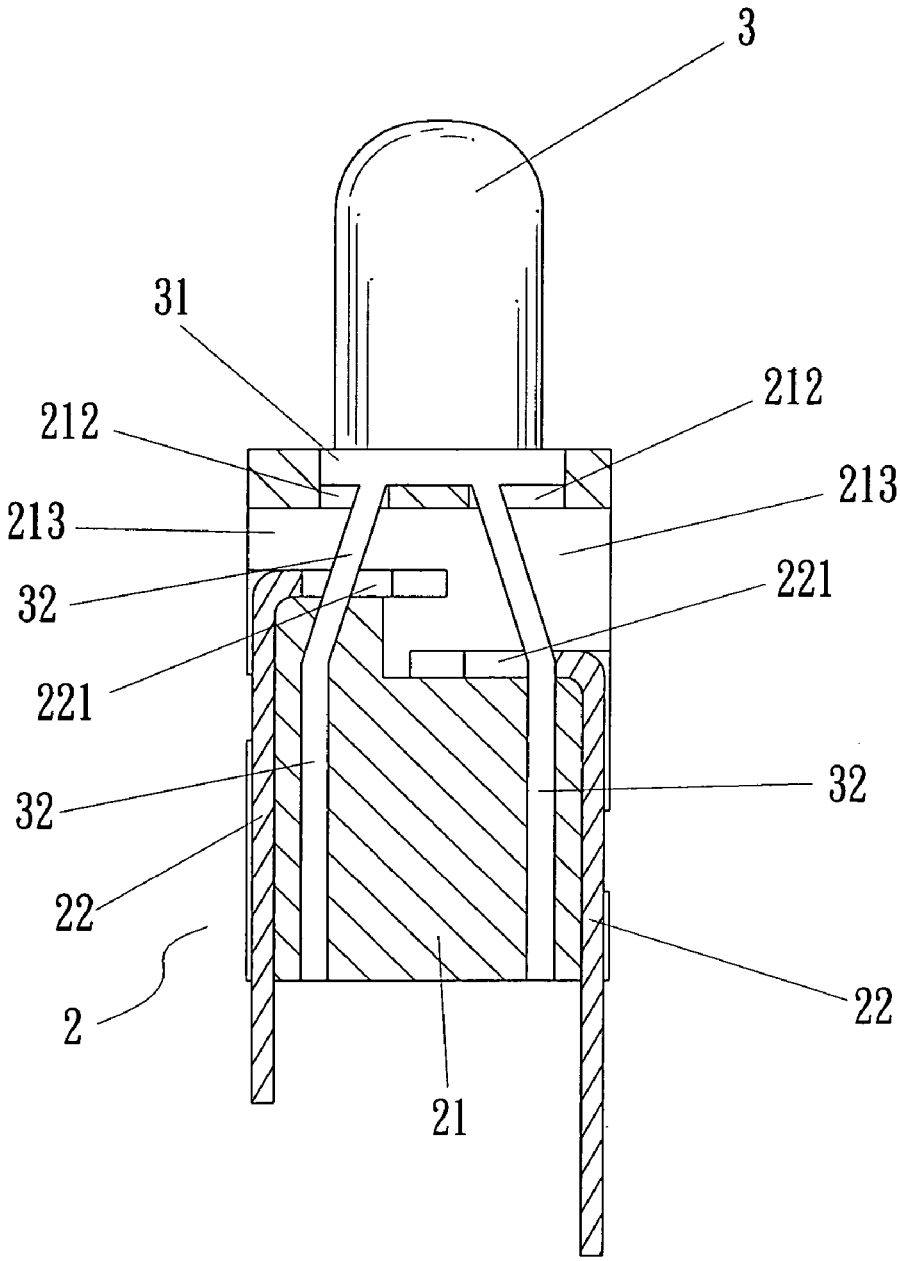
FIG. 5 is a cross sectional view of the LED light assembly of the present invention.
Figure 6:
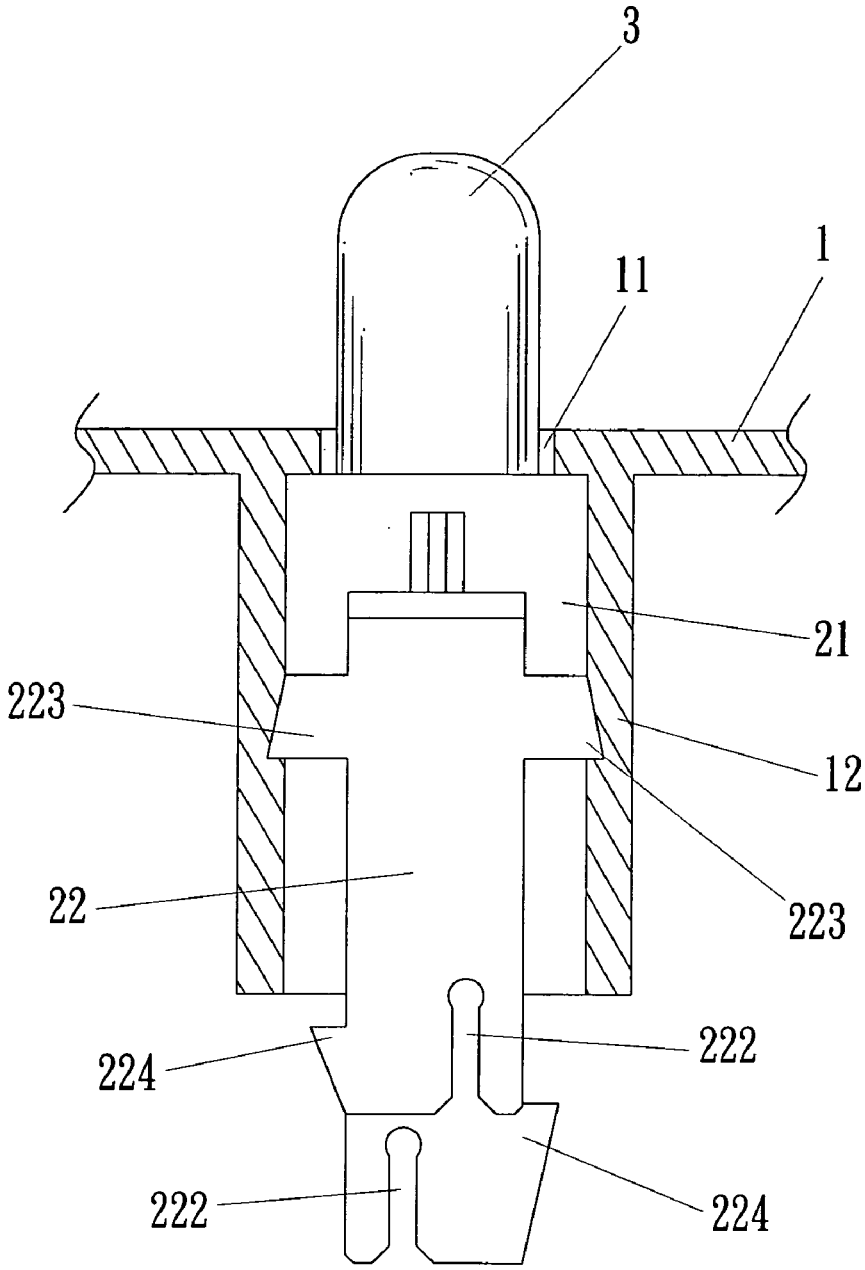
FIG. 6 shows the two arms of each conductive plate are engaged with insides of the insertion port.

Referring to FIGS. 1 to 6, the LED light assembly of the present invention comprises a light cover (not shown) and a backboard 1 which has a plurality of insertion ports 12 on a rear end thereof and a plurality of holes 11 are defined through the backboard 1 and communicate with the insertion ports 12. Each insertion port 12 is an elongate member and two positioning slots 121 are defined in two opposite walls of each of the insertion ports 12.

A plurality of LED assemblies 2 are inserted into the insertion ports 12 and each LED assembly 2 includes a base 21 which has two ridges 214 so as to be slidably inserted into the positioning slots 121. The base 21 of each LED assembly 2 has a recessed area 211 defined in the top thereof and two legs slots 212 are defined through an inner end defining the recessed area 211. The recessed area 211 further has a straight inner side 2111. Two side holes 213 are defined in each base 21 and located in different heights in the base 21, the side holes 213 are in communication with the leg slots 212.

Two conductive plates 22 each have a bent portion on a first end thereof so as to be inserted into the side hole 213 corresponding thereto and each bent portion has a clamping slot 221. Two arms 223 extend from two sides of each conductive plate 22 and distal ends of the two arms 223 are slightly protruded from the two sides of the base 21 such that the two arms 223 are in contact with insides of the insertion port 12 to securely position the base 21 in the insertion port 12. Each conductive plate 22 further has a hook portion 224 defined in a second end thereof so as to be hooked to the cover. A cable slot 222 is defined in the second end of each conductive plate 22.

An LED 3 includes a flange 31 and two legs 32 extending from the flange 31 which is received in the recessed area 211 of each base 21. The flange 31 of each LED 3 has a straight side 311 such that the straight side 311 is matched with the straight inner side 2111. This prevents the assemblers from wrongly installing the LED 3. The two legs 32 are inserted through the leg slots 212 and are clamped by the clamping slots 221 of the bent portions of the conductive plates 22 to form a circuit. The LEDs 3 extend through the holes 11 of the backboard 1 and the cables 40 are then inserted into the cable slots 222.

Figure 7:
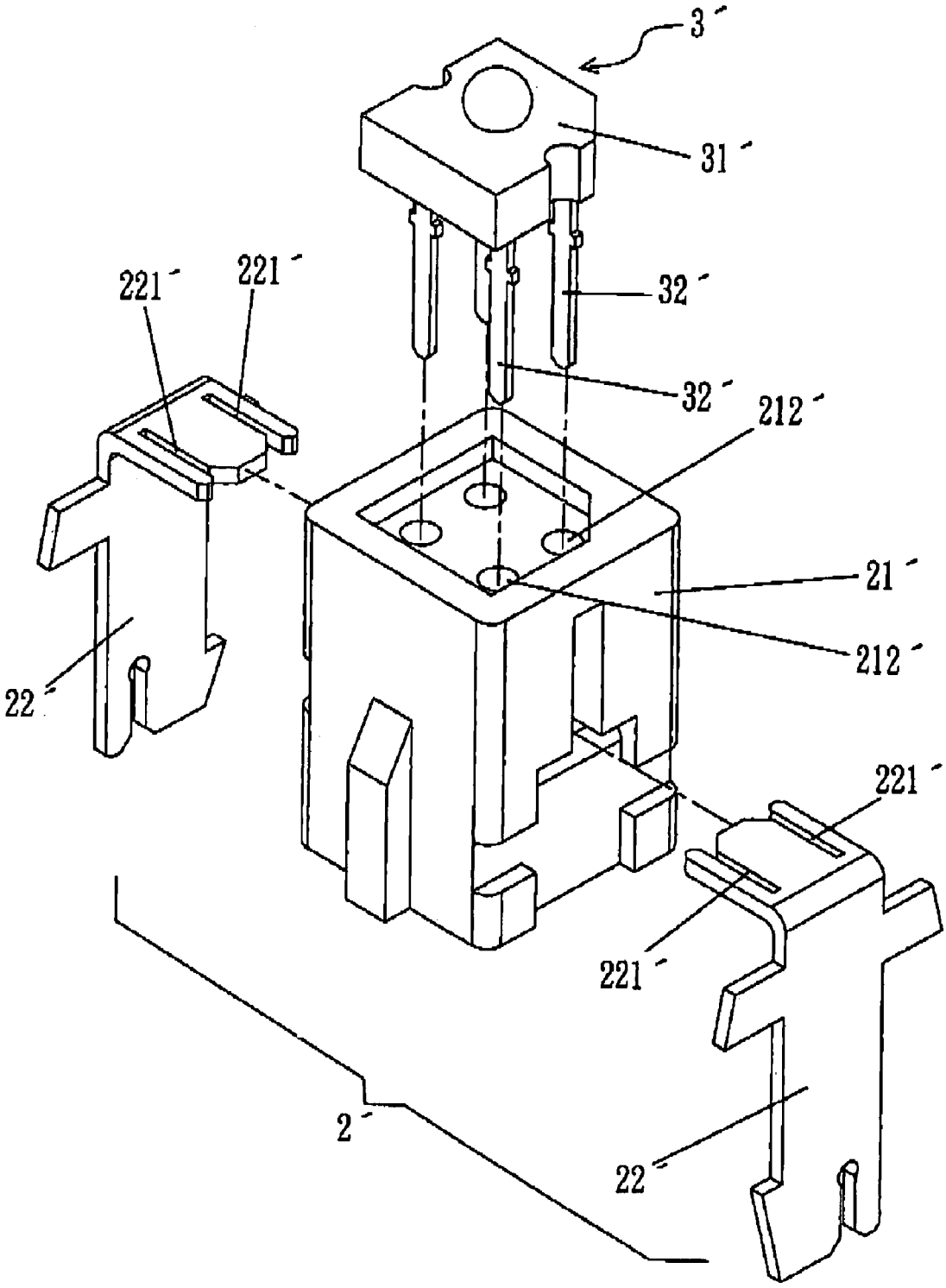
FIG. 7 is an exploded view to show another embodiment of the LED assembly of the present invention.

As shown in FIG. 7, when the LED 3' of each LED assembly 2' includes four legs 32' extending from the flange 31', then the number of the leg slots 212' in the base 21' should be four and each bent portion of each conductive plate 22' has two clamp slots 221' so as to respectively position the four legs 32'.

While we have shown and described the embodiment in accordance with the present invention, it should be clear to those skilled in the art that further embodiments may be made without departing from the scope of the present invention.

What is claimed is:

1. An LED light assembly comprising:

a backboard having a plurality of insertion ports on a rear end thereof and a plurality of holes defined through the backboard and communicating with the insertion ports, and a plurality of LED assemblies inserted into the insertion ports and each LED assembly including a base which has at least two leg slots defined through a top thereof and two side holes which are in communication with the at least two leg slots, two conductive plates respectively connected to the base of each LED assembly and each conductive plate having a bent portion on a first end thereof, the bent portion inserted into the side hole and having at least one clamping slot, an LED connected to the base of each LED assembly and including a flange and at least two legs, the at least two legs inserted through the at least two leg slots and being clamped by the clamping slots of the bent portions of the conductive plates, the LEDs extending through the holes of the backboard.

2. The assembly as claimed in claim 1, wherein each insertion port is an elongate member and two positioning slots are defined in two opposite walls of each of the insertion ports, each base has two ridges which are slidably inserted into the positioning slots.

3. The assembly as claimed in claim 1, wherein the flange of each LED has a straight side and the base of each LED assembly has a recessed area defined in the top thereof and the at least two legs slots are defined through an inner end defining the recessed area, the recessed area has a straight inner side such that the flange is engaged with the recessed area and the straight side is matched with the straight inner side.

4. The assembly as claimed in claim 1, wherein each conductive plate has two arms extending from two sides thereof and the two arms are in contact with insides of the insertion port.

5. The assembly as claimed in claim 1, wherein each conductive plate has a hook portion defined in a second end thereof.

6. The assembly device as claimed in claim 1, wherein each conductive plate has a cable slot defined in a second end thereof.

* * * * *